US006431853B1

(12) United States Patent
Sher

(10) Patent No.: US 6,431,853 B1
(45) Date of Patent: Aug. 13, 2002

(54) LIGHTER

(75) Inventor: Tak Chi Sher, Quarry Bay (HK)

(73) Assignee: Polycity Enterprise Limited, Quarry Bay (HK)

( * ) Notice: Subject to any disclaimer, the term of this patent is extended or adjusted under 35 U.S.C. 154(b) by 0 days.

(21) Appl. No.: 09/776,757

(22) Filed: Feb. 6, 2001

(51) Int. Cl.[7] ..... F23Q 2/28

(52) U.S. Cl. ..... 431/153; 431/255; 431/132; 431/129; 431/130; 431/131

(58) Field of Search ..... 431/153, 277, 431/255, 129, 131, 132, 133, 134, 135, 136, 137, 138, 139, 140, 141; 292/166, 167, 172, 173, 139

(56) References Cited

U.S. PATENT DOCUMENTS 552,489 A * 12/1895 Armstrong
930,598 A * 8/1909 Henry
1,139,706 A * 5/1915 Newpher
1,171,775 A * 2/1916 Downing
1,256,992 A * 2/1918 Edgar et al.
1,304,244 A * 5/1919 Appleby
1,706,085 A * 3/1929 Straubel
2,484,738 A * 10/1949 Reid
2,701,459 A * 2/1955 Williams
3,442,598 A * 5/1969 Halm
6,135,761 A * 10/2000 Chen
6,186,772 B1 * 2/2001 Huang

FOREIGN PATENT DOCUMENTS

DE 699213 * 10/1940

* cited by examiner

*Primary Examiner*—Carl D. Price
(74) *Attorney, Agent, or Firm*—Nath & Associates PLLC; Harold L. Novick

(57) ABSTRACT

The invention comprises a lighter such as a cigarette lighter including a housing. Ignition means are provided for the lighter. The ignition means include a member manually movable with respect to the housing. A lock between the manually moveable member and the housing, and release means are provided which are manually operable to release the lock to allow the manually moveable member to move relative to the housing to allow or cause ignition of the lighter. The release means require manual movement to release the lock in a direction different to the direction of movement of the manually moveable member to allow or cause ignition.

7 Claims, 8 Drawing Sheets

LIGHTER

BACKGROUND

This invention relates to a lighter, particularly a small portable lighter of the type used to light cigarettes, cigars and other small combustible items.

With lighters presently available such as with the prior art lighter hereinafter described it is possible for children to cause the lighter to ignite by operating an ignition device by relatively simple manual manipulation. Such ignition could also occur accidentally when the lighter is contained in a pocket, handbag or similar container. It will of course be apparent that such a situation where the lighter can be ignited by children or accidentally is undesirable and dangerous.

OBJECT

It is therefore an object of the present invention to provide a lighter that will obviate or minimise the foregoing disadvantages in a simple yet effective manner or which will at least provide the public with a useful choice.

STATEMENTS OF THE INVENTION

Accordingly the invention consists in a lighter including a housing, ignition means for the lighter, the ignition means including a member manually moveable with respect to the housing, a lock between the manually moveable member and the housing, and release means manually operable to release the lock to allow the manually moveable member to move relative to the housing to allow or cause ignition of the lighter, the release means requiring manual movement to release the lock in a direction different to the direction of movement of the manually moveable member to allow or cause ignition.

Preferably the manually moveable member comprises a cap rotatably mounted on the lighter and the lock is mounted on the cap.

Preferably the cap is hollow and the lock comprises a bar moveable in a channel in the cap, the bar being biased to a position wherein the distal end of the bar engages or abuts part of the housing to substantially prevent movement of the cap relative to the housing.

Preferably the lock further comprises a release member pivotally mounted on the cap, the release member having one end extending from the cap to receive in use manual pressure and engaging the bar at or adjacent the other end thereof Preferably the angle of movement between the direction of movement of the release member to cause release of the cap from the housing is substantially at right angles to the direction of the movement of the cap relative to the housing to affect the ignition of the lighter.

Preferably the bar is biased by a compression spring within the cap.

Preferably the bar has a notch in the distal end thereof to engage an adjacent edge of the housing.

Preferably the end of the release member is bifurcated, one arm passing each side of the spring to engage lugs on the bar.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION DRAWINGS

One preferred form of the invention will now be described with reference to the accompanying drawings in which, FIGS. 1 and 2 are partial cross sections of a prior art lighter.

Figure 1:
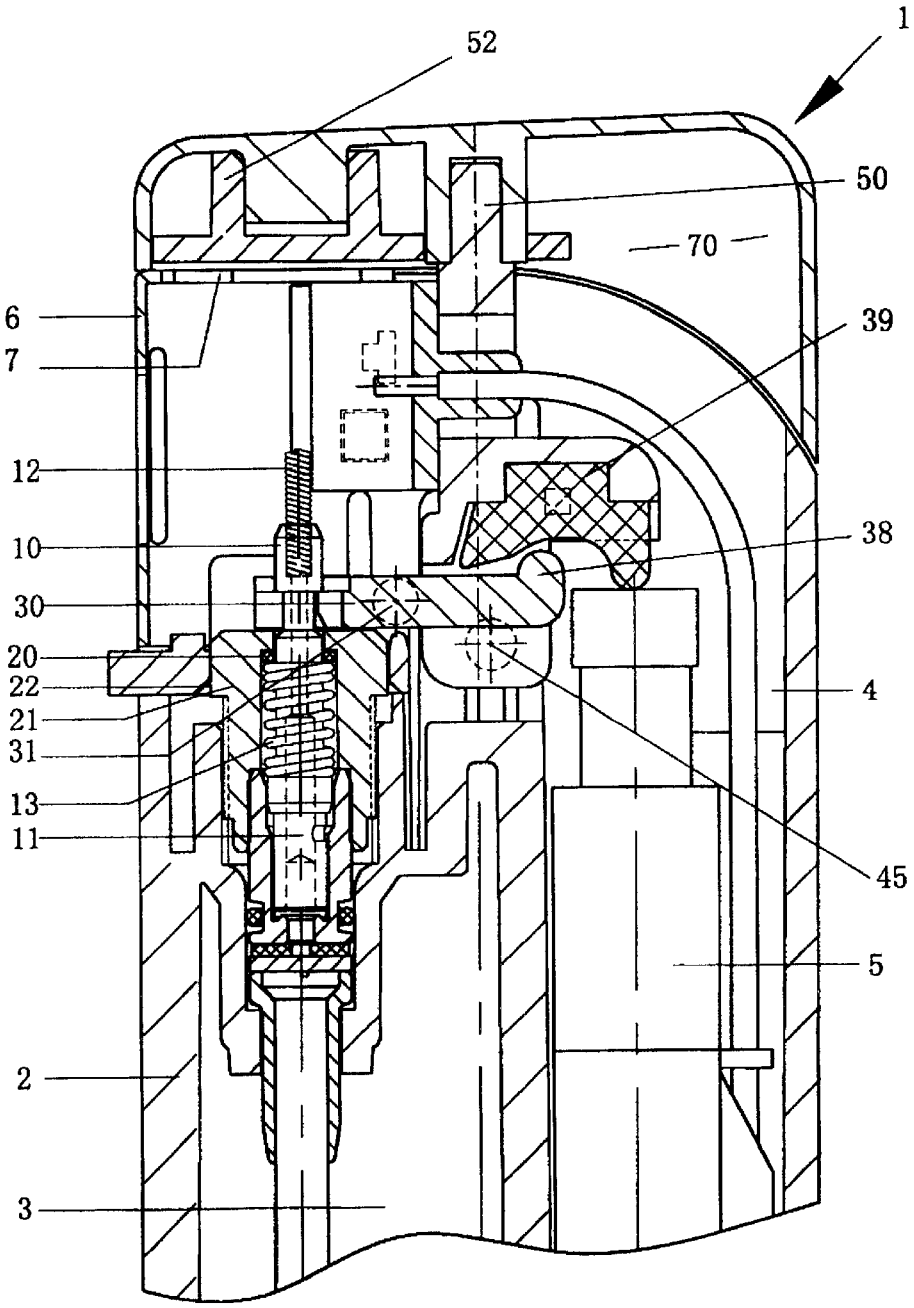
FIG 1 (PRIOR ART)
FIG. 1 shows the lighter in a closed unlit or "off" position.
Figure 2:
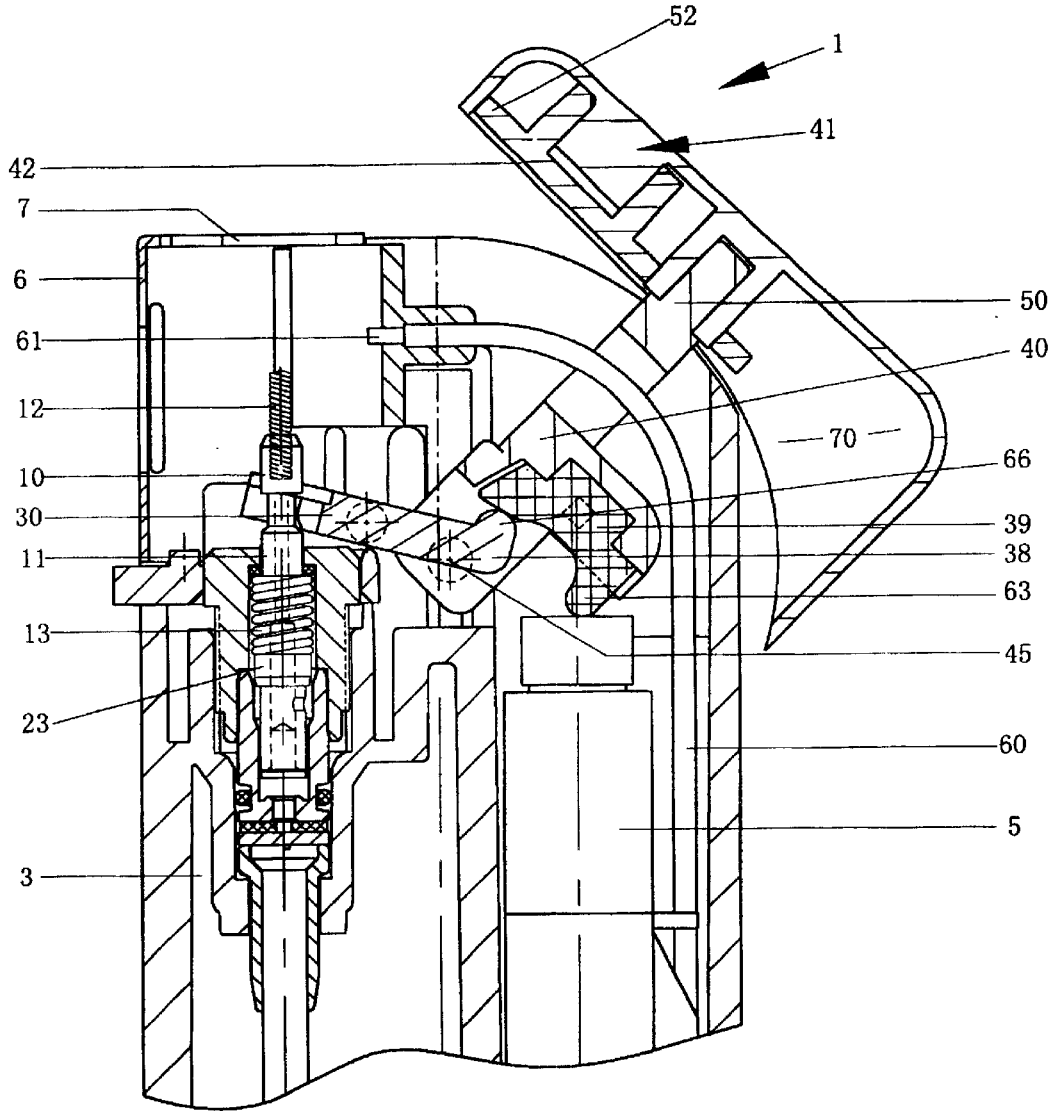
FIG 2 (PRIOR ART)
FIG. 2 shows the lighter at the end of the striking action.
Figure 3:
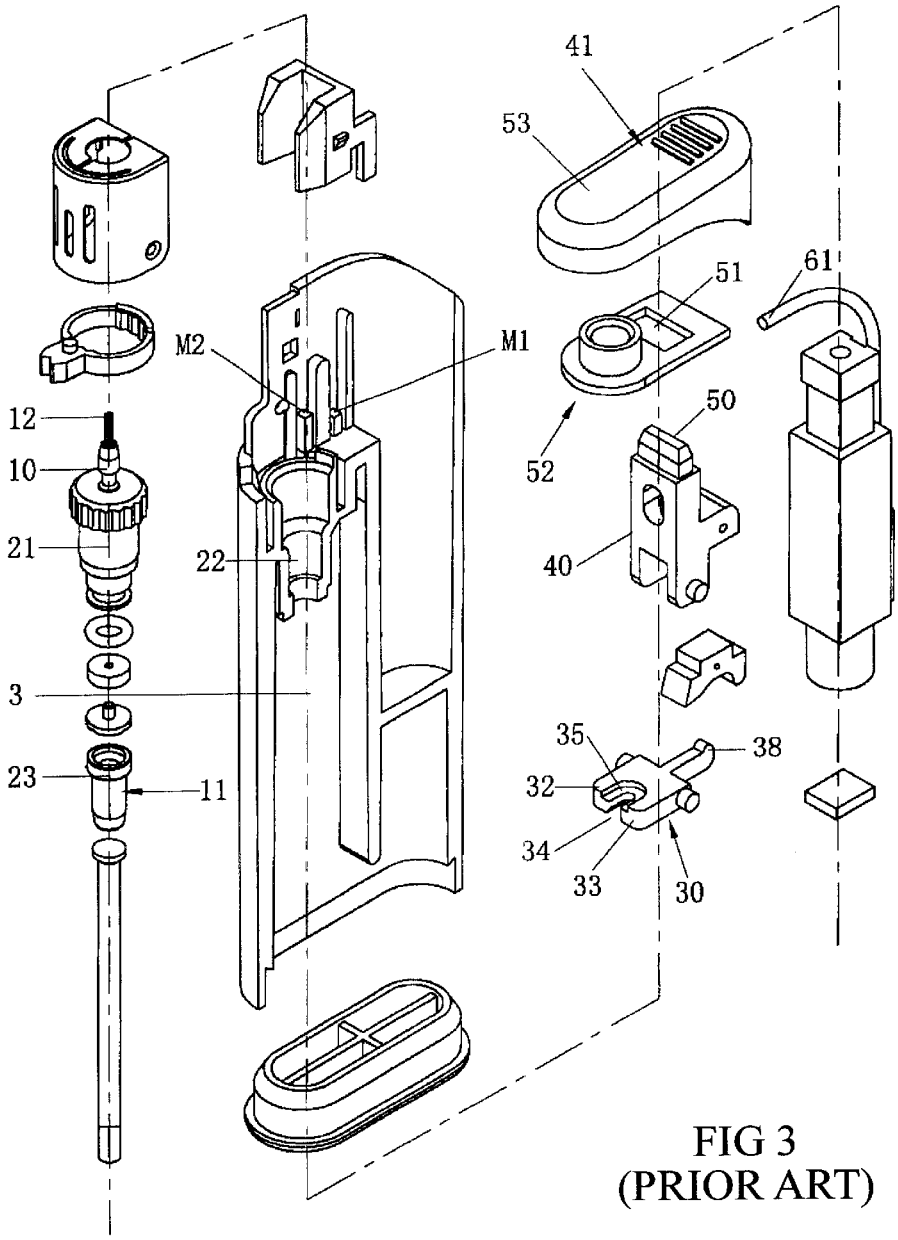
FIG 3 (PRIOR ART)
Figure 4:
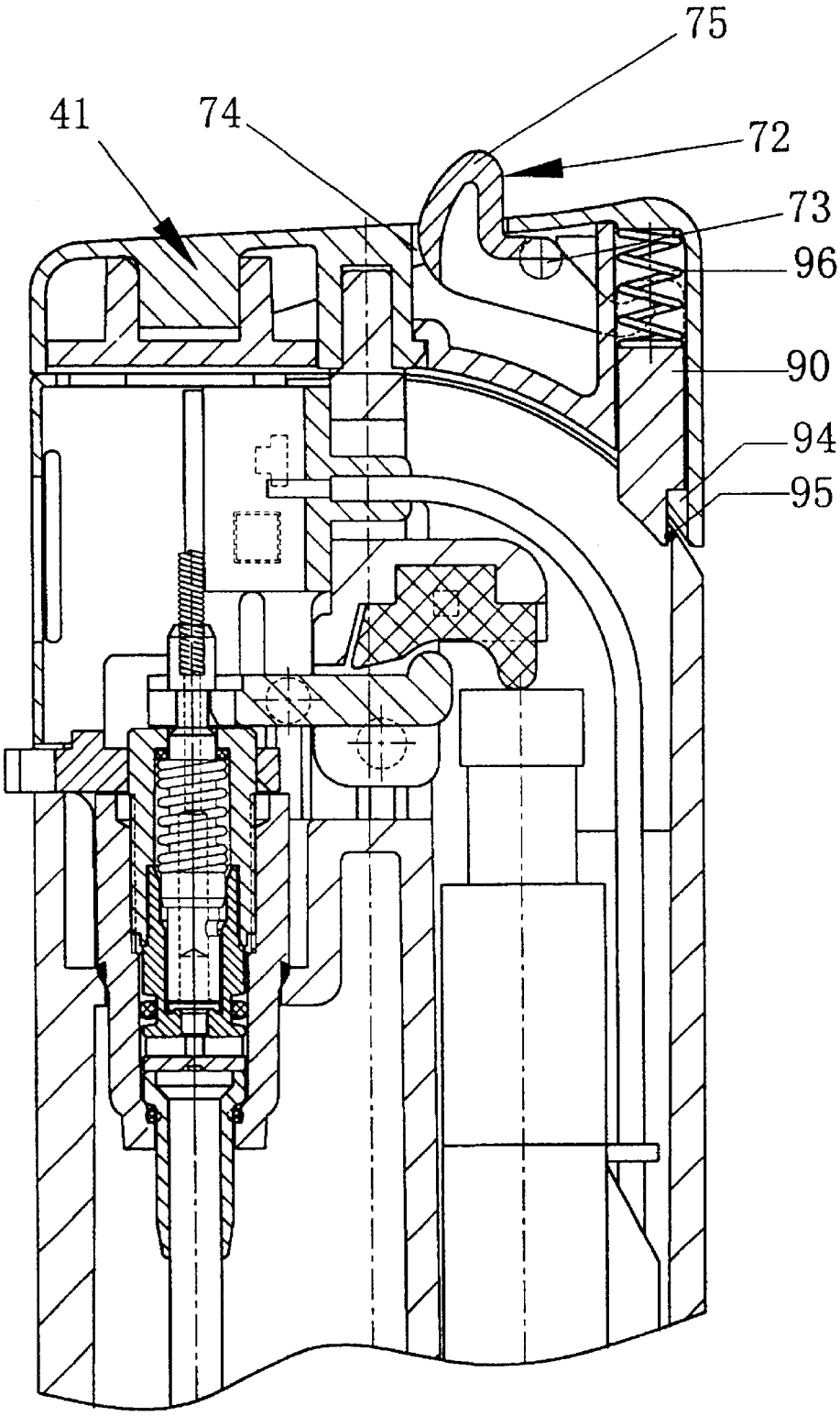
Figure 5:
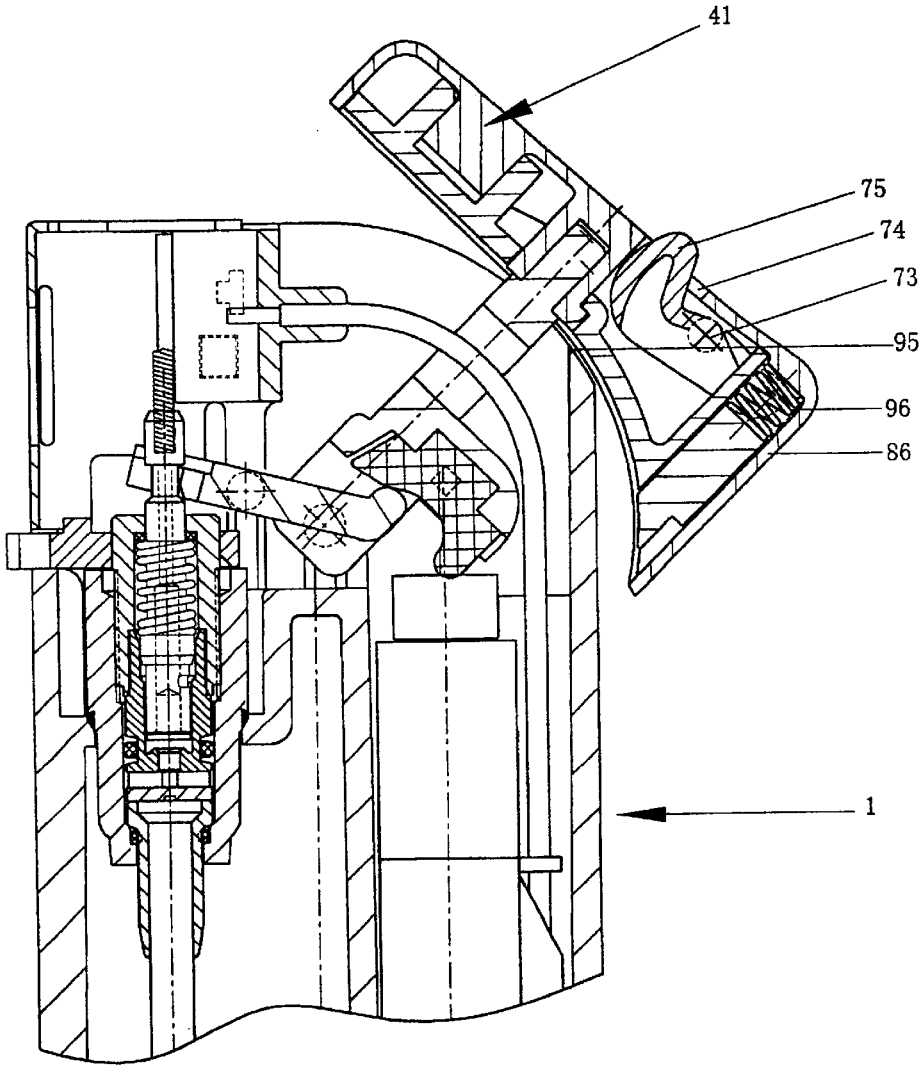
Figure 6:
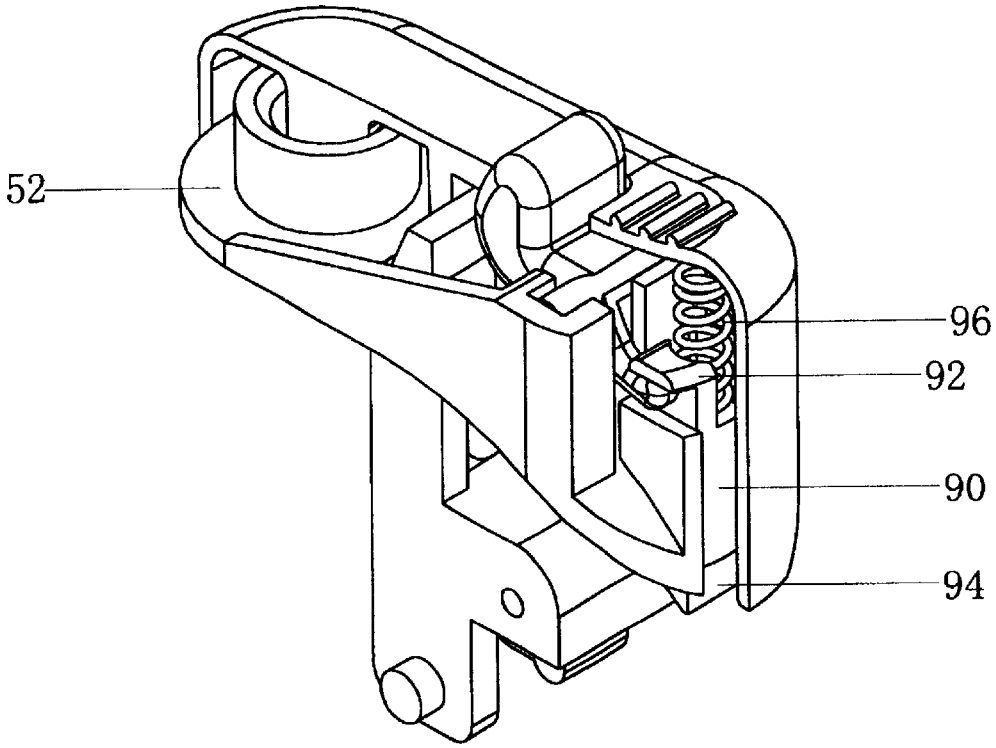
Figure 7:
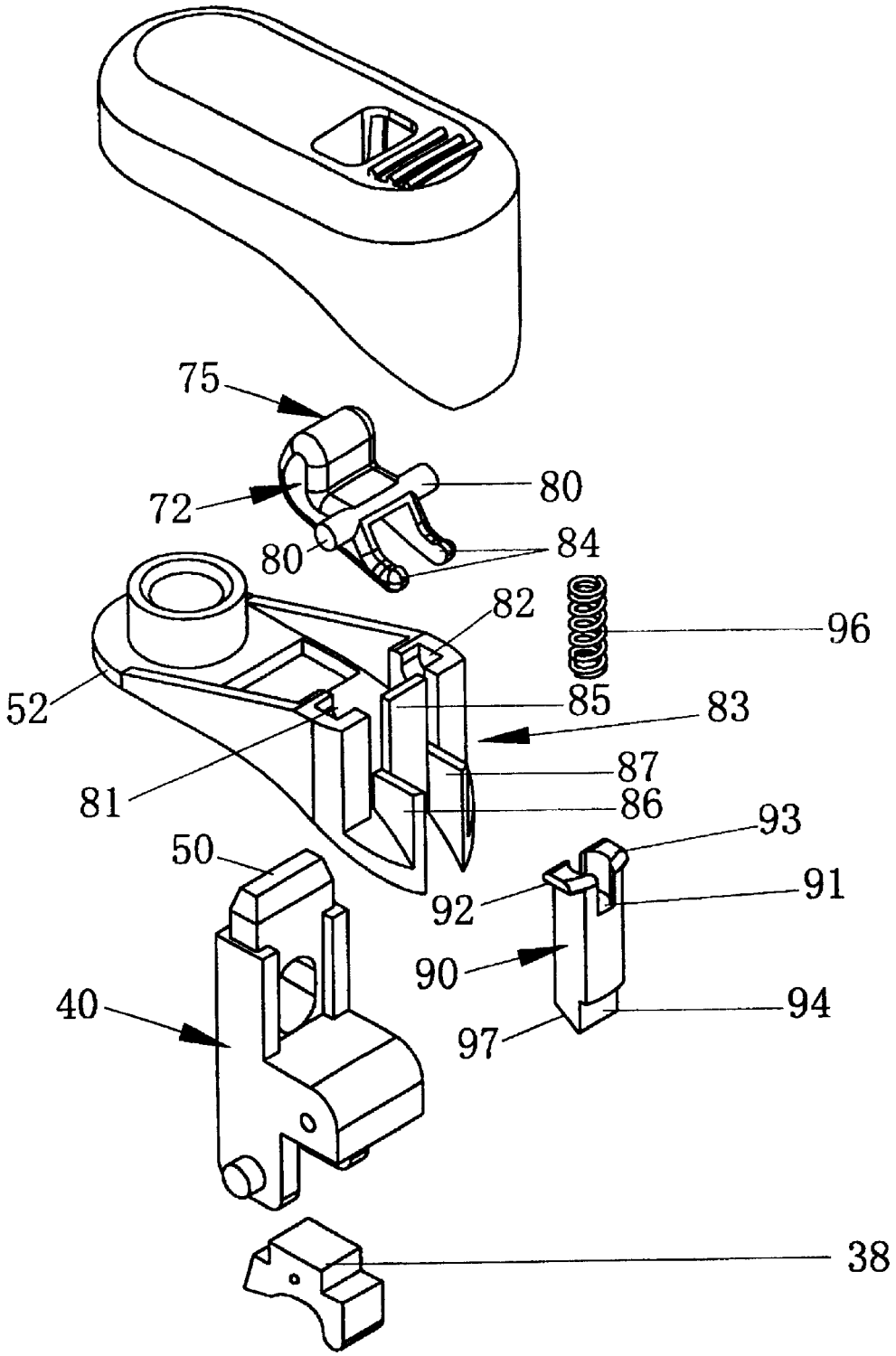
Figure 8:
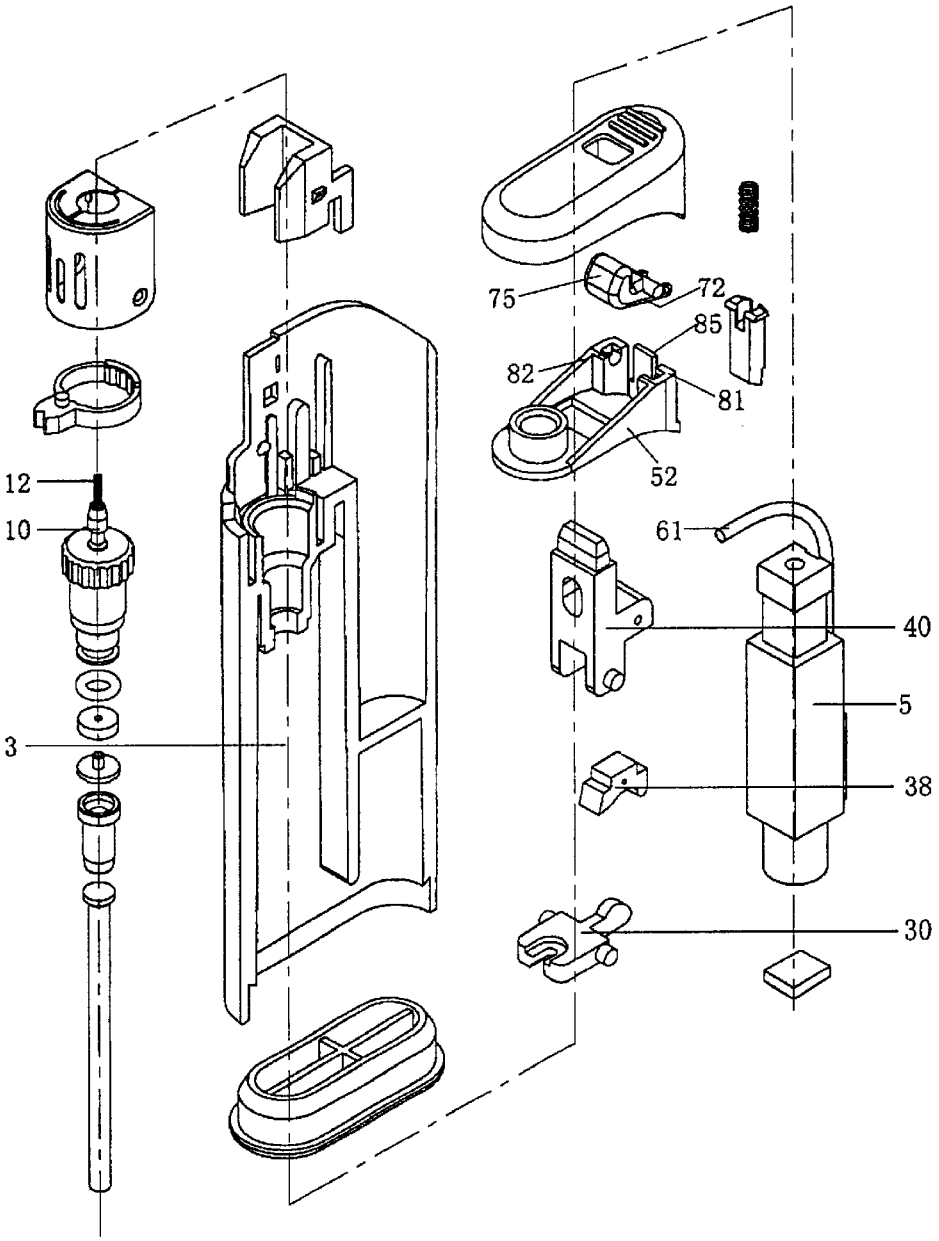

FIG. 3 is a partial exploded view of parts of a lighter according to the prior art embodiment of FIGS. 1 and 2, FIGS. 4 and 5 are partial cross sectional views of a lighter in the "off" and the "ignited" position respectively in one preferred form of the present invention, FIG. 6 is a perspective partially cut away view of a manually manipulable member for causing the lighter to ignite according to the preferred form of the invention, FIG. 7 is an exploded view of FIG. 6, and FIG. 8 is a view as in FIG. 3 but of the lighter according to one FIGS. 4 and 5.

DESCRIPTION

Referring to FIGS. 1, 2 and 3 the prior art lighter 1 comprises a housing 2 which provides a gas chamber 3 and a compartment 4 housing piezo electric unit 5. Above the tank 3 is provided a flame guard 6 with an aperture 7 therein. Gas nozzle 10 is mounted on hollow support 11 which receives gas from the gas chamber 3 in substantially the current known manner. The nozzle 10 which also is of substantially a known type carries a lighting spring 12. The nozzle 10, lighting spring 12, and support 11 are held in a withdrawn position by a biasing device such as spring 13 which is compressed between shoulders 20, provided in an apertured plug 21 which is fitted to an aperture 22 in the housing 2, and a collar 23 about the member 1.

The gas passageways are opened by lifting the member 11 and nozzle 10 to the position shown in FIG. 2 and this can be achieved by providing a lever 30 pivotally connected to the housing at 31. The lever 30 has a bifurcated end providing arms 32 and 33 which engage the nozzle 10. Between the arms is provided a space 34 having a wider recess 35 in which the nozzle 10 sits.

The opposite end 38 of lever 30 is engaged by a pressure member 39. The pressure member 39 is mounted on a downwardly depending stem 40 of a manually manipulable cap 41 which also provides a surface 42 to cover the aperture 7 when the lighter is in the "off" position. The stem 40 is pivotally connected to the housing at 45 and the upper end of the stem 40 has a plug 50 which engages in an aperture 51 in a plate 52 forming the bottom part of the cap 41. The cap 41 also includes an upper part 53.

The piezo electric unit 5 has a wire 60 which extends from the unit 5, the wire being positioned so that distal end 61 of wire 60, which provides are electrode, is positioned near the spring 12. The other electrode is provided by electrical contact between the piezo electric unit 60, the pressure unit 39, the lever arm 38, the nozzle 10 and the spring 12.

In use when the cap 41 is manipulated manually into the position shown in FIG. 2 pressure from a downwardly depending lug 63 on unit 39 causes the piezo electric unit 5 to operate whilst at the same time downward pressure on lug 66 of lever arm 38 raises the nozzle 10 and spring 12. The gas then flowing from the nozzle is ignited in substantially the known manner.

When the flame is no longer required the cap returns to the position shown in FIG. 1 shutting off the gas flow and releasing pressure on the piezo electrode unit 5. The return of the cap 41 is effected a biasing devices such as a spring which in the preferred form, forms part of the piezo electric unit 5.

Referring now to FIG. 4 the construction is similar except where modified as herein described.

The invention takes advantage of the fact that there is a space 70 in the cap 41 of the prior art construction. The invention provides a lever 72 pivotally connected to the cap at 73. An aperture 74 is provided in the cap 41 and a lobe 75 extends from the lever 72 outwardly through the aperture 74. The lobe 75 provides a release member.

Pivot arms 80 on the lever 72 are held in a pair of slots 81 and 82 provided on an extension 83 to the lower cap part 52. The lever 72 provides a pair of bifurcated arms 84 therefor which extend each side of a plate 85 forming part of the bottom part 52 and further extend between spaced part plates 86 and 87. Thus the plates 86, 87 the member 85 and the adjacent wall part 88 of the top cap part 41 form a channel in which a member 90 may move. The member 90 has a cut out depression 91 between a pair of outwardly extending arms 93. The arms 84 of the lever 72 are positioned against the lower surfaces of the arms 92 and 93 (in the orientation shown for example FIG. 7). The member 90 at its lower end has a notch 94 which with the member 90 in the position shown in FIG. 4 is positioned so that the upper edge 95 of the housing is positioned in the notch 94.

A biasing member such as a spring 96 is positioned in the depression 91 and abuts the under side of the top part of the cap. Spring 96 in shown as a compression spring but any device capable of effecting the desired movement can be used.

The shape of the lobe 75 is such that in order to rotate the lever 72 a substantially downward pressure (with the lighter in the orientation shown in FIG. 4 for example) must be performed. This is achieved by making the lobe 75 extend somewhat at right angles to the longitudinal axis of the lever 72.

In use the lobe 75 is pushed inwardly towards the internal parts of the cap 41. This causes the lever 72 to rotate forcing the arms 84 against the undersides of the arms 93 lifting the member 90 against the biasing pressure of spring 96. Thus the member 90 is lifted clear of the edge 95 of the housing 1. The cap can then be manually rotated substantially as described in relation to FIGS. 1, 2 and 3.

When the cap is allowed to return to its "off" position as described in relation to FIG. 1 the edge 95 again becomes positioned in the notch 94 because of the sloped surface 97 at the end of the member 90 running on the edge 95 causing the member 90 to move against the spring pressure 96 until the edge 95 snaps into the notch 94.

Thus it can be seen that at least in the preferred form the invention a lighter is provided which has a safety features in that the cap cannot be manually manipulated until the lobe extending outwardly from the cap is pressed inwardly of the cap. It is believed that it would be difficult for children to complete both the inward pressing of the lobe and backward rotation of the cap at the same time thereby providing a substantially child proof locking device to the lighter. It is also believed that it would be difficult for these movements to occur accidentally.

What is claimed is:

1. A lighter including:

a housing including a chamber formed therein to receive lighter fuel therein;

a gas emitting nozzle in the housing, the gas emitting nozzle being in communication with the lighter fuel;

a valve operable to allow gas to flow from the chamber to the nozzle;

ignition means operable to open the valve and to cause gas to flow to the nozzle, the ignition means including, a hollow cap having an opening therein, the cap being manually moveable with respect to the housing and there being a channel in the cap, a lock mounted between the cap and the housing, which lock comprises a bar moveable in the channel, biasing means to bias the bar to a position wherein one end of the bar engages or abuts part of the housing to substantially prevent movement of the cap relative to the housing; and a release means manually operable to release the lock and thereby allow the cap to move relative to the housing in a selected direction to open the valve and allow or cause ignition of the gas at the nozzle, the release means including a release member pivotally mounted on the cap, and which release member has one end extending through the opening in the cap and able to receive in use manual pressure thereon and the other end of the release member engaging the bar to move the bar against the biasing means so that the cap can move relative to the housing, the direction of movement of the one end of the release member to cause release of the cap from the housing being into the opening in the cap and substantially at right angles to the direction of movement of the cap relative to the housing which allows or causes ignition of the lighter.

2. A lighter as claimed in claim 1 wherein biasing means comprise a spring within the cap.

3. A lighter as claimed in claim 2 wherein the spring is a compression spring.

4. A lighter as claimed in claim 2 further comprising a notch in the bar, the notch being in the one end of the bar to engage an adjacent edge of the housing.

5. A lighter as claimed in claim 3 wherein the other end of the release member is bifurcated having two arms, one arm passing on each side of the spring, and further comprising lugs on the bar, the ends of the arms engaging the lugs.

6. A lighter as claimed in claim 1 wherein the cap comprises a top part and a bottom part, the bottom part carrying said channel and the release member being pivotally mounted on said bottom part.

7. A lighter as claimed in claim 6 wherein the release member has a bifurcated arm passing one each side of the bar and being engageable therewith.

* * * * *